US008246705B2

(12) United States Patent
Bain et al.

(10) Patent No.: US 8,246,705 B2
(45) Date of Patent: Aug. 21, 2012

(54) EXHAUST AIR MIST SEPARATOR

(76) Inventors: Charles E. Bain, El Paso, TX (US); David D. Williams, El Paso, TX (US)

( * ) Notice: Subject to any disclaimer, the term of this patent is extended or adjusted under 35 U.S.C. 154(b) by 0 days.

(21) Appl. No.: 12/799,322

(22) Filed: Apr. 22, 2010

(65) Prior Publication Data

US 2010/0275900 A1 Nov. 4, 2010

Related U.S. Application Data

(60) Provisional application No. 61/214,399, filed on Apr. 23, 2009.

(51) Int. Cl.
*B01D 51/00* (2006.01)

(52) U.S. Cl. ..... 55/467; 55/385.1; 55/385.2; 55/447; 55/337; 55/463; 55/471; 55/473; 55/442; 55/423; 55/404; 55/350.1; 55/421; 55/DIG. 18; 55/DIG. 36; 95/91; 95/141; 126/299 E; 126/299 R; 454/41; 454/67; 423/245.3

(58) Field of Classification Search ..... 55/467, 55/385.1, 385.2, 447, DIG. 18, DIG. 36, 55/337, 463, 471, 473, 442, 423, 404, 350.1, 55/421; 126/299 E, 299 R; 454/41, 67; 423/245.3, 423/215.3; 95/91, 141
See application file for complete search history.

(56) References Cited

U.S. PATENT DOCUMENTS

| | | | | |
|---|---|---|---|---|
| 264,093 | A | 9/1882 | Maypole | |
| 1,509,674 | A | 9/1924 | Koehler | |
| 1,732,315 | A | 10/1929 | Ray | |
| 2,793,712 | A | 5/1957 | Graswich | |
| 3,616,744 | A * | 11/1971 | Jensen | 126/299 E |
| 3,713,279 | A * | 1/1973 | Moore | 55/319 |
| 4,010,011 | A * | 3/1977 | Reif | 96/61 |
| 4,179,273 | A * | 12/1979 | Montusi | 55/457 |
| 4,351,652 | A * | 9/1982 | Wisting | 96/265 |
| 4,411,675 | A * | 10/1983 | de Castella | 96/140 |
| 4,475,534 | A * | 10/1984 | Moriarty | 126/299 D |
| 4,506,655 | A | 3/1985 | Kuechler | |
| 4,753,218 | A * | 6/1988 | Potter | 126/299 E |
| 4,869,236 | A | 9/1989 | Blough | |
| 4,977,884 | A | 12/1990 | Kaufman | |
| 4,987,882 | A | 1/1991 | Kaufman | |
| 5,020,511 | A | 6/1991 | Liu | |
| 5,154,161 | A * | 10/1992 | Rogers et al. | 126/299 D |
| 5,163,869 | A * | 11/1992 | Yeh et al. | 454/67 |
| 5,472,342 | A | 12/1995 | Welsh | |
| 5,509,851 | A | 4/1996 | Heuschkel | |
| 5,718,219 | A * | 2/1998 | Boudreault | 126/299 E |
| 5,814,115 | A | 9/1998 | Allen | |
| 6,010,558 | A | 1/2000 | Ackland | |
| 6,050,258 | A | 4/2000 | Neitzel | |
| 6,648,937 | B1 | 11/2003 | Nguyen | |
| 6,676,723 | B2 | 1/2004 | Chwala | |
| 6,716,099 | B2 | 4/2004 | Pfleiderer | |
| 7,332,004 | B2 | 2/2008 | Jackson | |
| 7,341,701 | B2 * | 3/2008 | Abehssera | 423/210 |
| 7,484,506 | B2 | 2/2009 | Besal | |
| 7,537,642 | B2 | 5/2009 | Damrath | |
| 7,614,396 | B2 * | 11/2009 | So | 126/299 E |

(Continued)

*Primary Examiner* — Jason M Greene
*Assistant Examiner* — Dung H Bui
(74) *Attorney, Agent, or Firm* — R. Wayne Pritchard

(57) ABSTRACT

A grease containment apparatus to remove grease and other contaminants from hot air exiting a kitchen area through a vent system which includes a vertical separator.

17 Claims, 13 Drawing Sheets

U.S. PATENT DOCUMENTS

| | | | | |
|---|---|---|---|---|
| 7,699,051 | B2 * | 4/2010 | Gagas et al. | 126/299 D |
| 7,767,003 | B2 * | 8/2010 | Van Niekerk | 95/214 |
| 7,785,382 | B2 * | 8/2010 | Morton | 55/332 |
| 7,947,123 | B2 * | 5/2011 | Kwok et al. | 95/267 |
| 2002/0179084 | A1 * | 12/2002 | Swierczyna et al. | 126/299 R |
| 2003/0192528 | A1 * | 10/2003 | He | 126/299 D |
| 2004/0035411 | A1 * | 2/2004 | Livchak et al. | 126/299 R |
| 2004/0107956 | A1 * | 6/2004 | Lee | 126/299 R |
| 2006/0219235 | A1 * | 10/2006 | Bagwell et al. | 126/299 R |
| 2007/0294985 | A1 * | 12/2007 | Leseman et al. | 55/385.2 |
| 2008/0083333 | A1 * | 4/2008 | Yokoi et al. | 95/277 |
| 2009/0042500 | A1 * | 2/2009 | Robison et al. | 454/67 |
| 2009/0264060 | A1 * | 10/2009 | Livchak et al. | 454/61 |
| 2009/0301305 | A1 | 12/2009 | Gaddy | |

* cited by examiner

Detail

EXHAUST AIR MIST SEPARATOR

This application claims priority over provisional patent application No. 61/214,399 filed on Apr. 23, 2009 and incorporated by reference herein in its entirety.

BACKGROUND OF INVENTION

1. Field of the Invention

This invention relates to generally a rooftop grease containment apparatus.

2. Description of the Prior Art

Since practically from the time cooking began, humans have recognized the importance of removing hot air and grease from the cooking area. As early as 1924, M. E. Koehler in U.S. Pat. No. 1,509,674, obtained patent protection for a simple vent apparatus used to purify greasy or sooty smoke and vapors arising from a kitchen range. By 1929, L. W. Ray in U.S. Pat. No. 1,732,315, recognized that the addition of an exhaust fan would improve the efficiency of the vent. By 1957, driven by the proliferation of fast food and drive-ins and the kitchen ranges used therein, E. Graswich, attempted in U.S. Pat. No. 2,793,712 to improve grease efficiency removal through an increase in the surface area within the vent system.

While over the years, many improvements such as those described in U.S. Pat. No. 7,537,642 (Damrath), U.S. Pat. No.7,484,506 (Besal), U.S. Pat. No.7,332,004 (Jackson), U.S. Pat. No. 6,050,258 (Neitzel), U.S. Pat. No. 5,472,342 (Welsh), U.S. Pat. No. 5,020,511 (Liu), and U.S. Pat. No. 4,506,655 (Kuechler) have been made to the simple vent apparatus of Koehler, the basic method has remained the same, that being a vent pipe generally located directly above the cooking surface, through which the heated air entrained with grease (or other contaminants) flows, sometimes with the assistance of an exhaust fan, to the roof of a building and exits to the surrounding atmosphere. As the grease entrained air travels up through the vent pipe, some grease becomes deposited upon the inner surfaces of the vent pipe. Any grease that exited the vent pipe into the ambient air would then, as a result of gravity, fall back and be deposited on the roof surfaces surrounding the vent. What was not appreciated in these earlier patents was the fact that grease accumulating on a roof posed a fire danger, could destroy the roof surfaces, and was extremely slippery when walked upon.

Beginning with the 1989 patent entitled "Apparatus for Collecting and Storing Grease Discharged from Roof Mounted Exhaust Systems", U.S. Pat. No. 4,869,236, issued to Blough, a method was disclosed for a way accumulate the grease exiting the vent into canisters. The concept of collecting grease through use of some form of cannister was subsequently utilized in U.S. Pat. No. 6,648,937 (Nguyen), U.S. Pat. No. 6,010,558 (Ackland), and U.S. Pat. No.4,987,882 (Kaufman). In U.S. Pat. No. 6,716,099, issued to Pfleiderer and U.S. Pat. No. 6,676,723 issued to Chwala, a method for accumulating grease in a catch basin built around the roof vent was disclosed. In order to increase the efficiency at which grease is removed from the hot air before such air exits the vent, other inventions patented during this time period such as US Patent Publication Number 2009/0301305 (Gaddy), and U.S. Pat. No. 5,814,115 (Allen) attempted to increase the surface area available for grease deposition by the utilization of a filter designed to filter out and collect the grease before the air exited the vent pipe.

In all of these patents, the efficiency of the vent system was limited by two interrelated factors, the speed of the air flowing through the vent and the efficiency at which grease is removed from the hot air before such air exits the vent. One way to increase the velocity of the air through the vent would be to increase the speed at which the exhaust fan rotates, however at some point the size of the fan desired would be cost prohibitive as well as structurally not supportable. One way to increase the efficiency at which grease is remove from the hot air before such air exits the vent is by use of a filter, however, filters are an impediment to air flow, must be periodically cleaned and/or replaced otherwise they will become clogged and, even when clean, will not eliminate all grease from exiting the vent. The most effective way to both increase the velocity of the air traveling through the vent while simultaneously improving the efficiency at which grease is removed from the air before such air exits the vent, is through the novel use of a vertical separator.

One only has to look at the roof of any restaurant to see, at least the roof portion, of any typical vent system. What one will see is a small length of duct work exiting the roof at the top of which is domed cover. Sometimes the domed cover may include the exhaust fan and/or any of the grease collection methods disclosed in the US patents discussed above. There are literally thousands if not hundreds of thousands of these types of vent installations throughout the United States. In order to be cost effective, any novel grease collection method such as that described in this patent application, must be able to be retrofitted to the existing vent systems.

SUMMARY OF THE INVENTION

It is, therefore, an object of the present invention to provide for an improved apparatus for the removal of grease from hot air exiting through a vent system from a kitchen. It is a further object of this invention to provide for an improved grease containment apparatus that can be easily retrofitted to existing kitchen and/or restaurant vent systems. Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as the basis for the claims and as a basis for teaching one skilled in the art how to make and/or use the invention.

Figure 1:
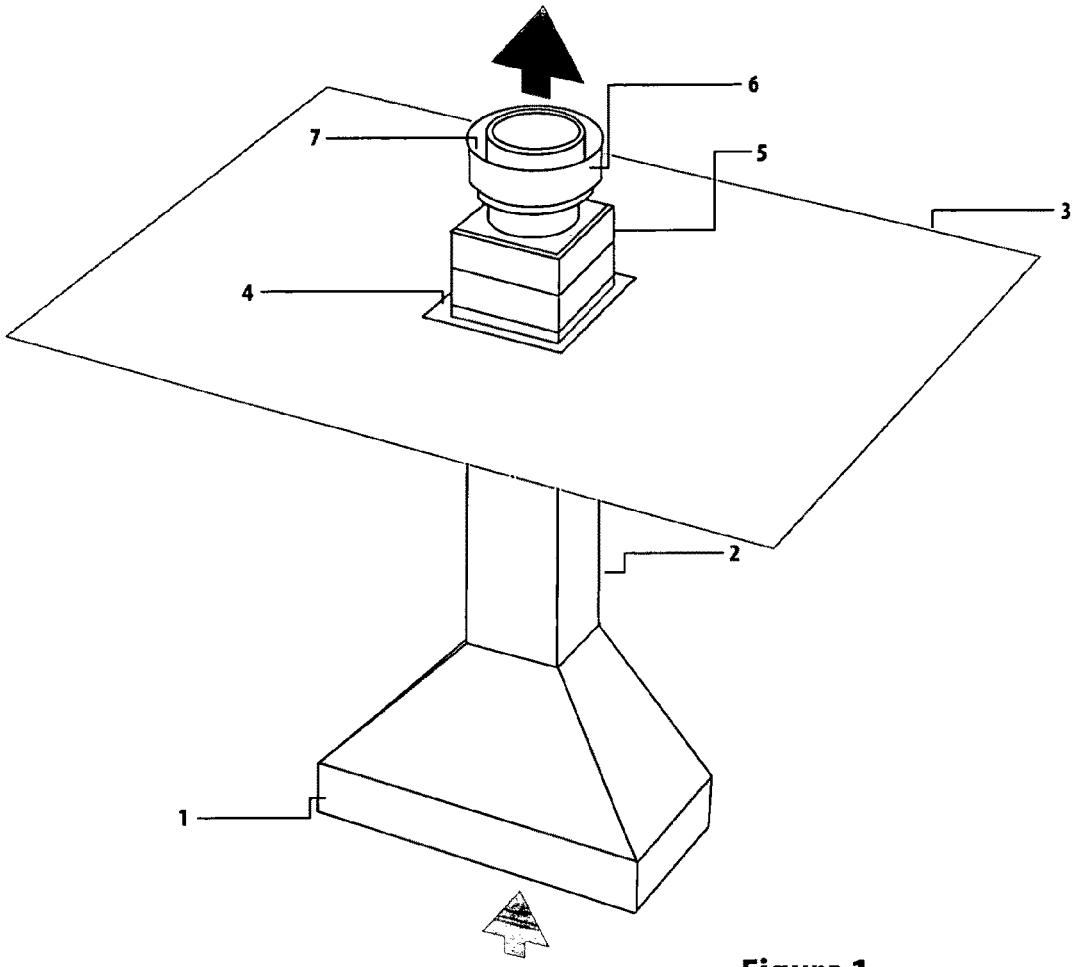
FIG. 1 is an illustration of a typical existing vent system.
Figure 2:
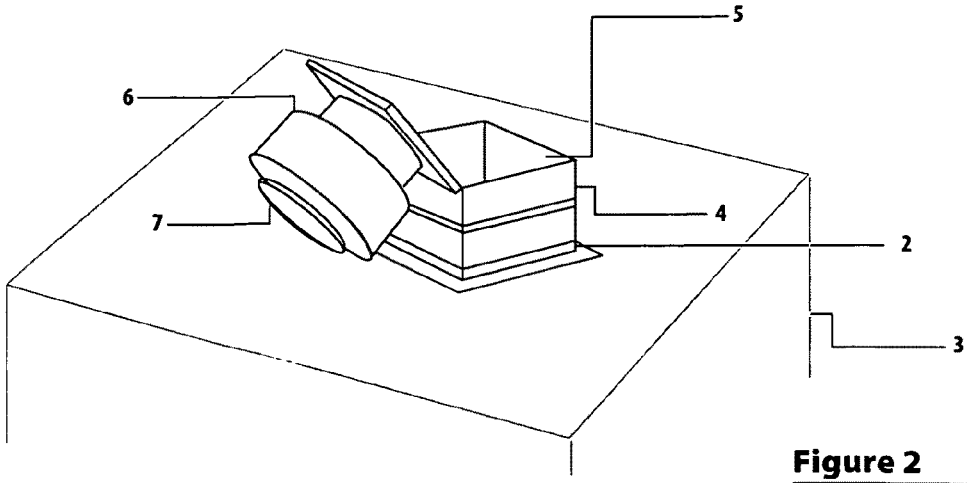
FIG. 2 illustrates how the domed portion (the vent cap) can be removed from an existing vent system to allow access to the duct work.

FIG. 1 illustrates a current technology vent system which comprises an exhaust hood [1], interior duct work [2] from the exhaust hood [1] to the roof surface [3], exterior duct work [4] from the roof surface [3] to the fan curb [5] and a vent cap [6] which includes an exhaust fan [7]. As shown in FIG. 1, hot air from the cooking surfaces is drawn into the exhaust hood [1] by the exhaust fan [7], travels up the interior duct work [2], through the exterior duct work [4], past the fan curb [5] and through the vent cap [6] to the surrounding atmosphere. Typically, as shown in FIG. 2, the vent cap [6] with exhaust fan [7] can be opened to allow access to the inside of the exterior duct work [4]. The exhaust fan [7] can be powered to spin through electricity supplied by any conventional means such batteries, solar power, or wind or can spin simply because of the principal that hot air rises.

Figure 3:
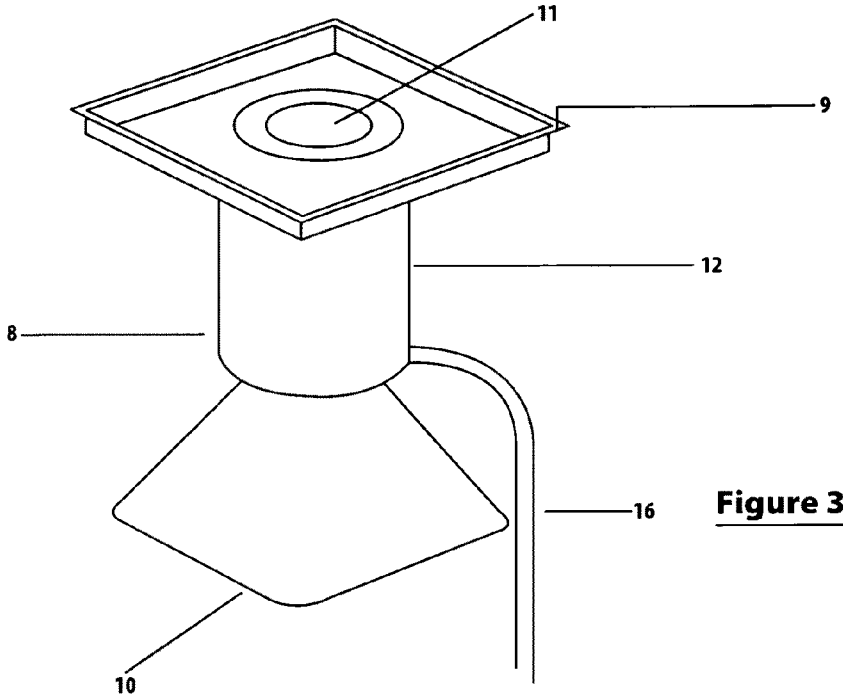
FIG. 3 is a side view of the present invention prior to installation within an existing vent system.
Figure 4:
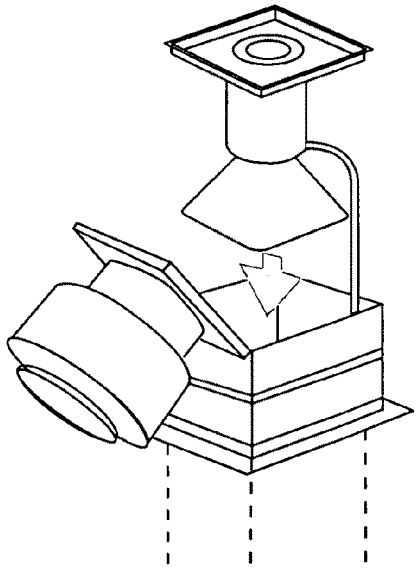
FIG. 4 depicts the present invention being installed.
Figure 5:
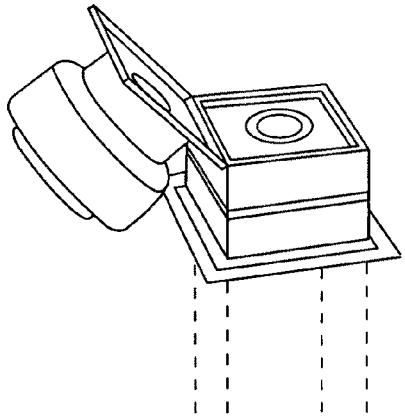
FIG. 5 illustrates the present invention installed prior to replacement of the vent cap.
Figure 6:
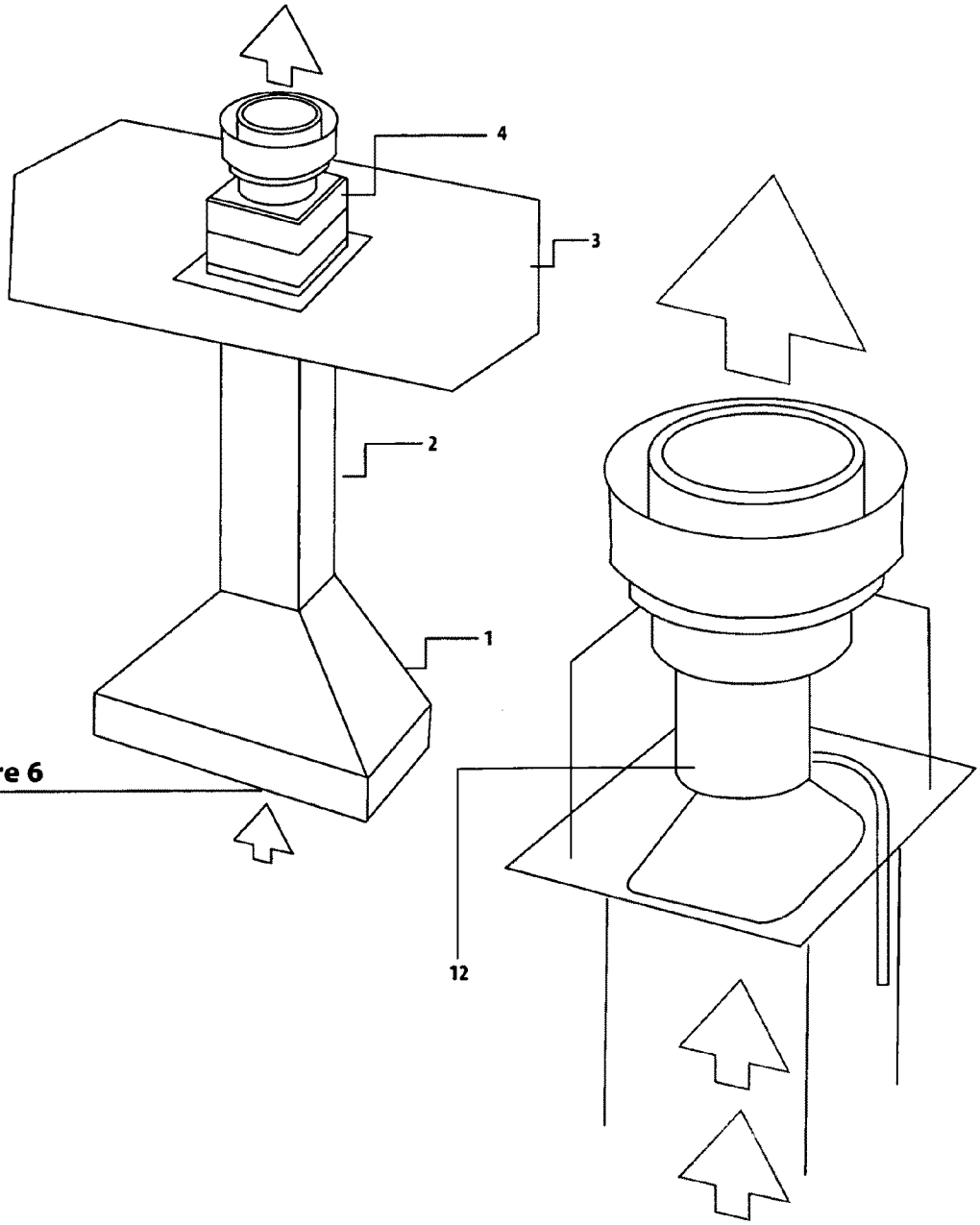
FIG. 6 illustrates the flow of air with contaminants through a vent system in which the present invention is installed.
Figure 8:
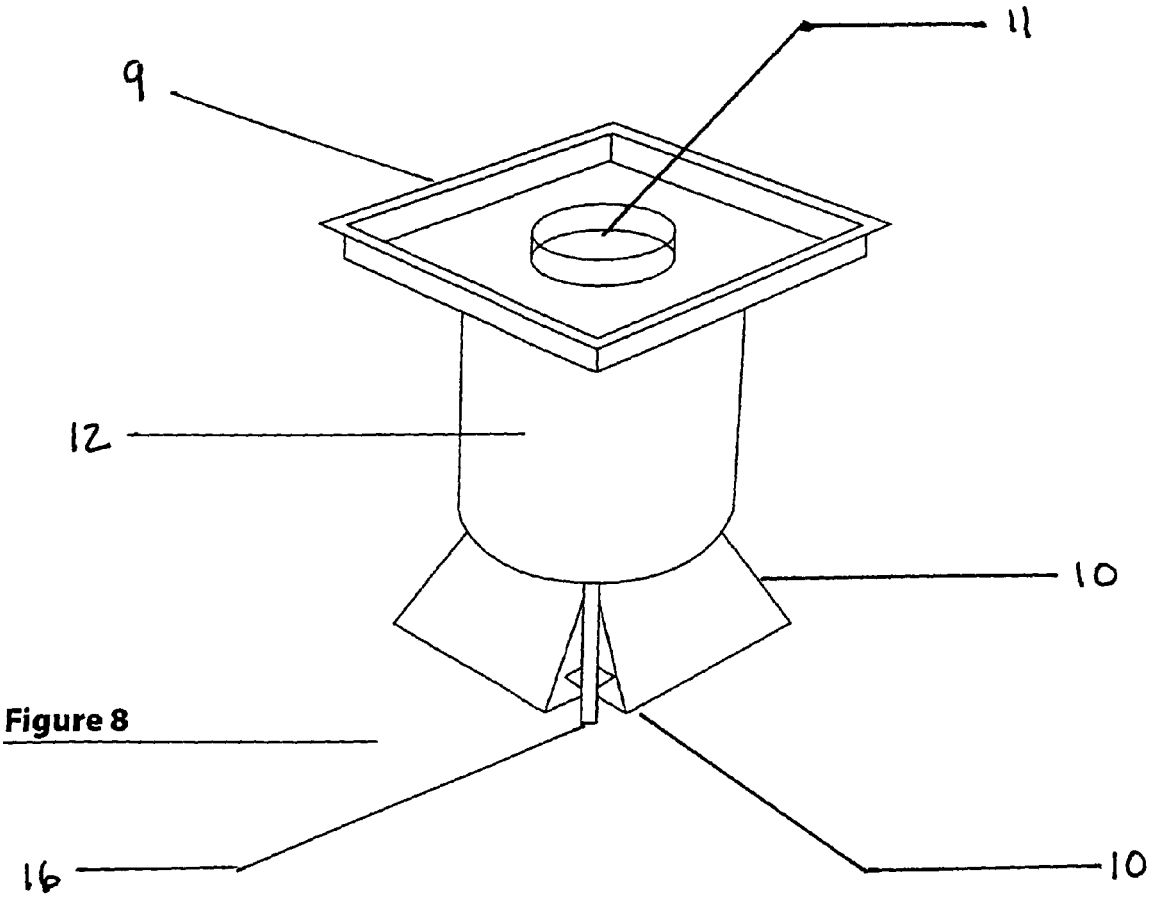
FIG. 8 is a side view of the mist separator components of the present invention.
Figure 9:
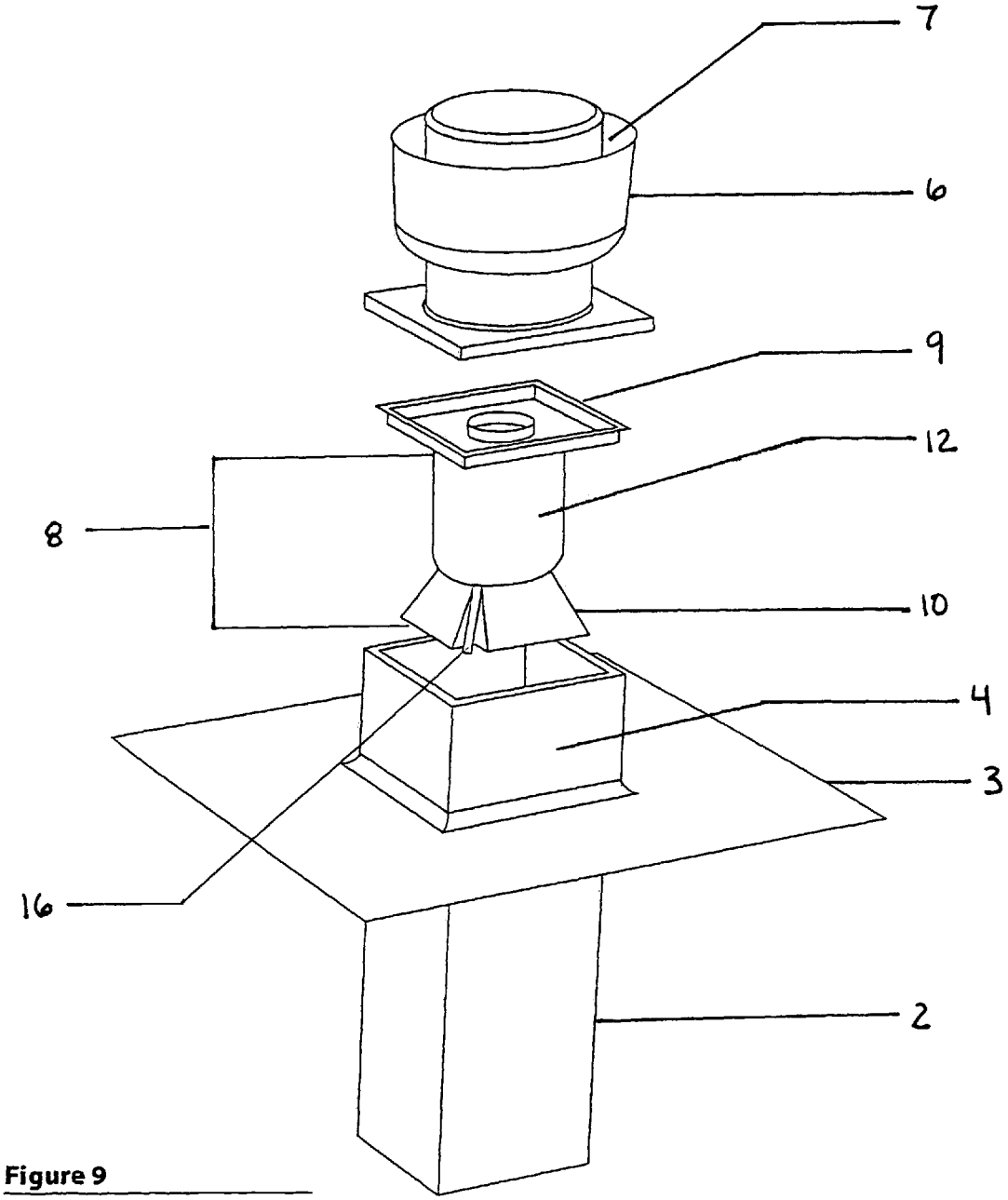
FIG. 9 is an exploded side view of the present invention as installed above the roof top surface.
Figure 14:
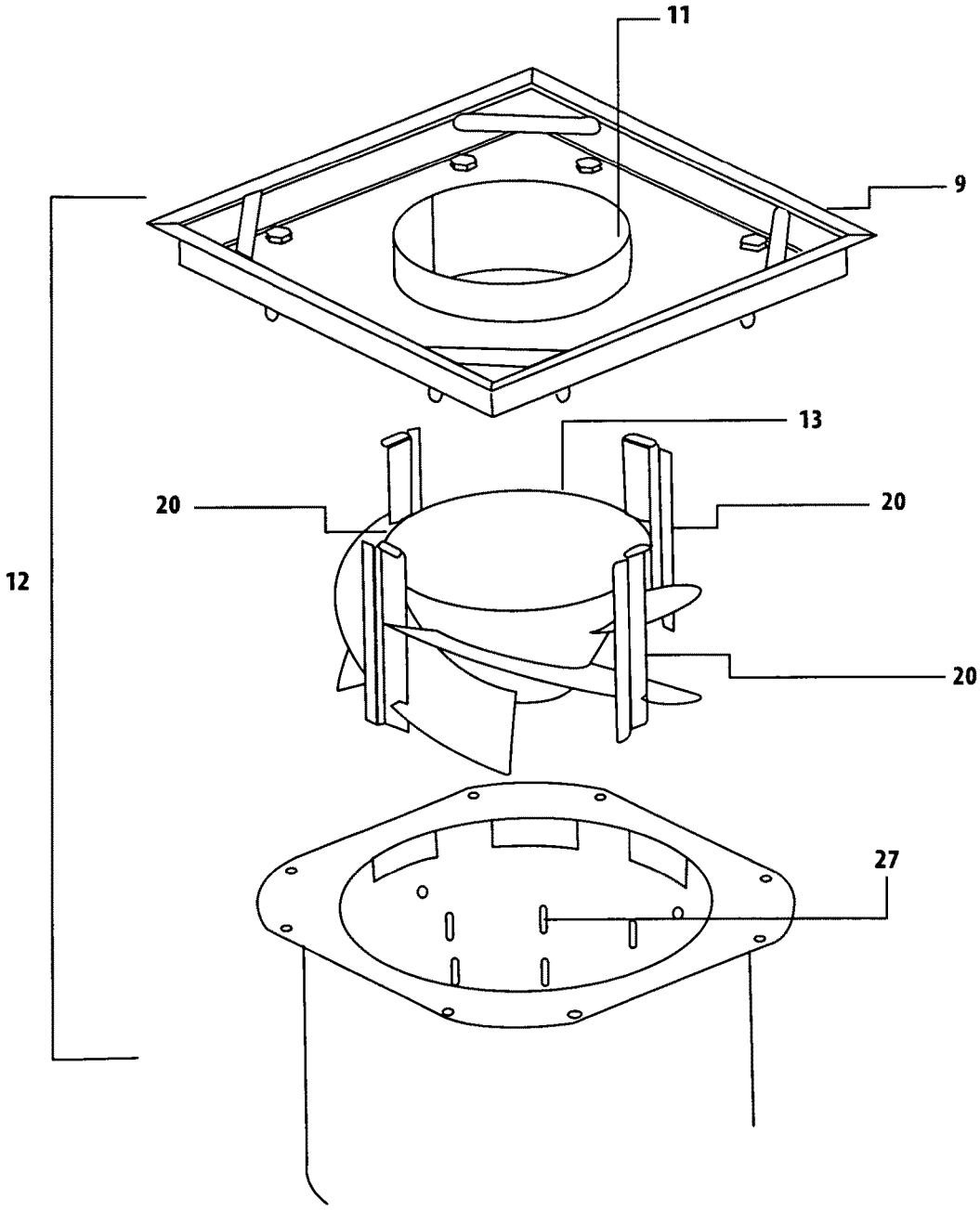
FIG. 14 illustrates the basic components of the mist separator apparatus of the present invention.
Figure 16:
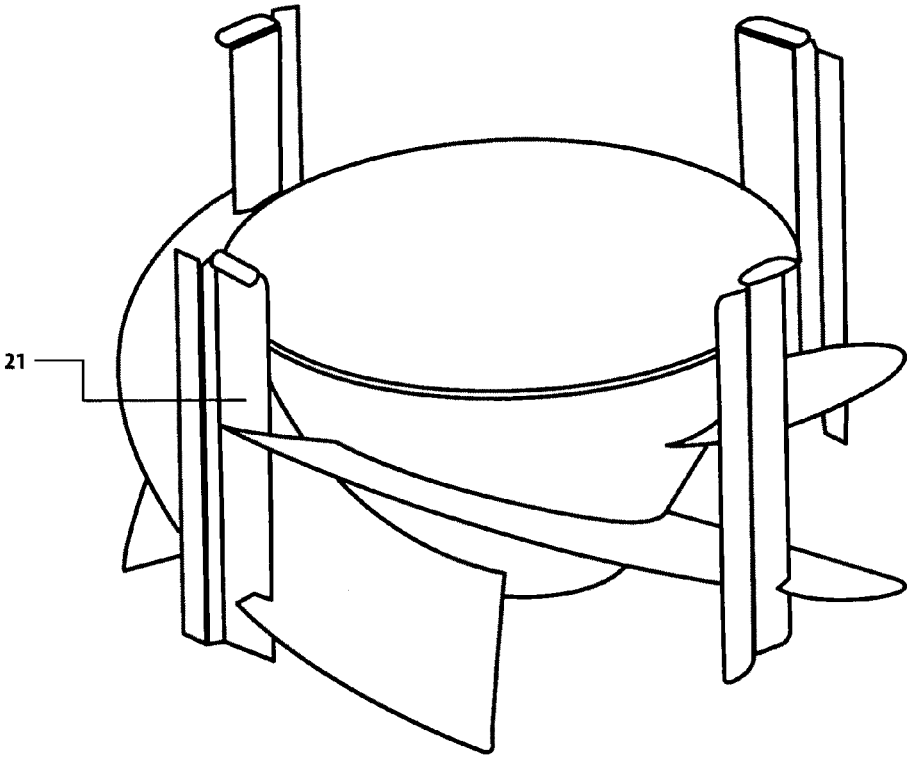
FIG. 16 depicts the edge of the attachment means.
Figure 16:
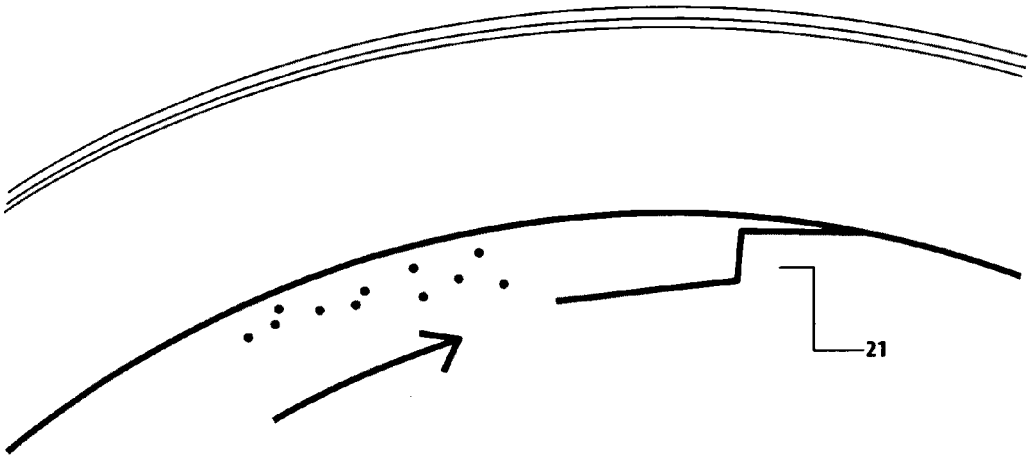

The mist separator component of the current invention [8] is shown in FIGS. 3, 8 and 9 and includes a mounting plate or bracket [9] located at the top of such component whose outside perimeter mates along the edges of exterior duct work [4], a funnel shaped air inlet [10] at the bottom of the mist separator component [8] whose inlet perimeter mates against the inside surface of the exterior duct work [4], an air outlet [11] which mates to the inlet to the exhaust fan [7], a separator device [12], and a drain line [16] through which the grease or other contaminants are removed from the hot air can be collected. As depicted in FIG. 14, the separator device [12] includes a conically shaped occlusion [13] whose diameter at the air outlet [11] is roughly the same diameter as such outlet and whose diameter at the air inlet [10] is smaller, which is supportably attached [20] using any conventional means such as angle iron, to the inside surface of the separator device [12] along the length of the conically shaped occlusion [13]. While the number of attachment means is not critical, at least 2 are required and as shown in FIG. 16, 4 attachment means are desired. While collected grease can be allowed to simply flow back down the inside surface of the interior duct work [2], this methodology is not efficient. To prevent this from occurring, in the present invention, the attachment means [20] shown in FIG. 16 includes an edge [21] along the length of the conically shaped occlusion [13], open to the direction of the air flow which allows grease or other contaminants to be collected. Once collected, grease will flow down the length of the attachment means to the bottom of the separator device [12] and exit the mist separator component [8] through a drain line [16]. The drain line [16] can be connected to any conventional device such as canisters for storage of the collected grease.

Principally, the function of the conically shaped occlusion [13] is to increase the velocity of the air as it flows past such occlusion forcing, through centrifugal force, contaminants from the air to be deposited on the inside surfaces of the exterior duct work [4], therefore, the precise size and location of the occlusion is not relevant so long as it will fit within the separator device [12], above the funnel shaped air inlet [10] and below the air outlet [11].

Figure 15:
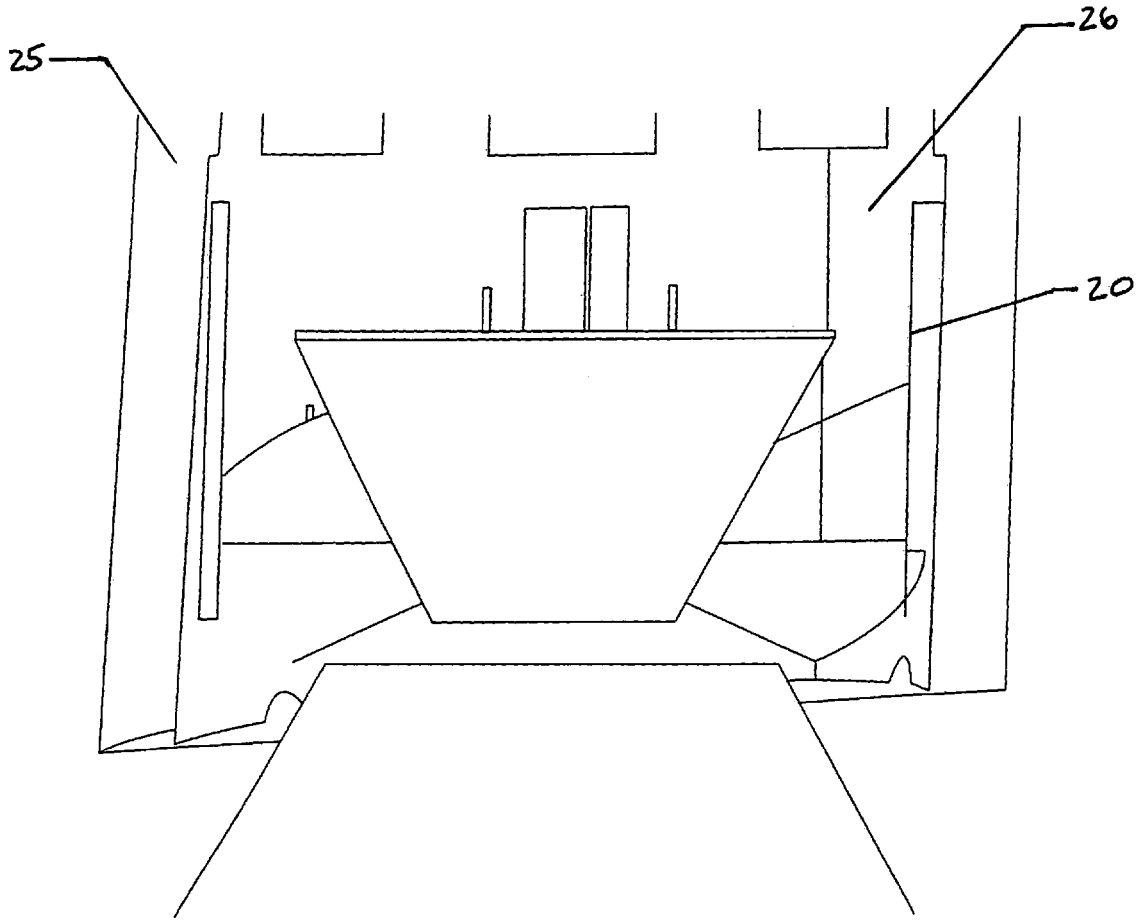
FIG. 15 illustrates an embodiment of the present invention in which the separator device includes and inner and outer shell.

In an alternative embodiment of the separator device [12], as shown in FIG. 15, such device can include an outer [25] and inner [26] shell. Air flow is directed using the funnel shaped air inlet [10] into the inner shell [26], and around the conically shaped occlusion [13]. The conically shaped occlusion [13] is supportably attached [20] along the length of the conically shaped occlusion [13] to the inside surface of the inner shell [26] using any conventional means such as angle iron. The attachment means [20] shown in FIG. 16 includes an edge [21] open to the direction of the air flow which allows grease or other contaminants to be collected. Once collected, grease will flow down the length of the attachment means [20] to the bottom of the separator device [12] and exit the mist separator component [8] through a drain line [16]. There is no air flow through the outer shell [25], however, holes [27] placed in the wall between the outer shell [25] and inner shell [26] permit any grease or other contaminants not collected by the attachment means [20] to pass through into the outer shell [25] and then by gravity, flow down the separator device into the drain line [16]. The drain line [16] can be connected to any conventional device such as canisters for storage of the collected grease.

Figure 11:
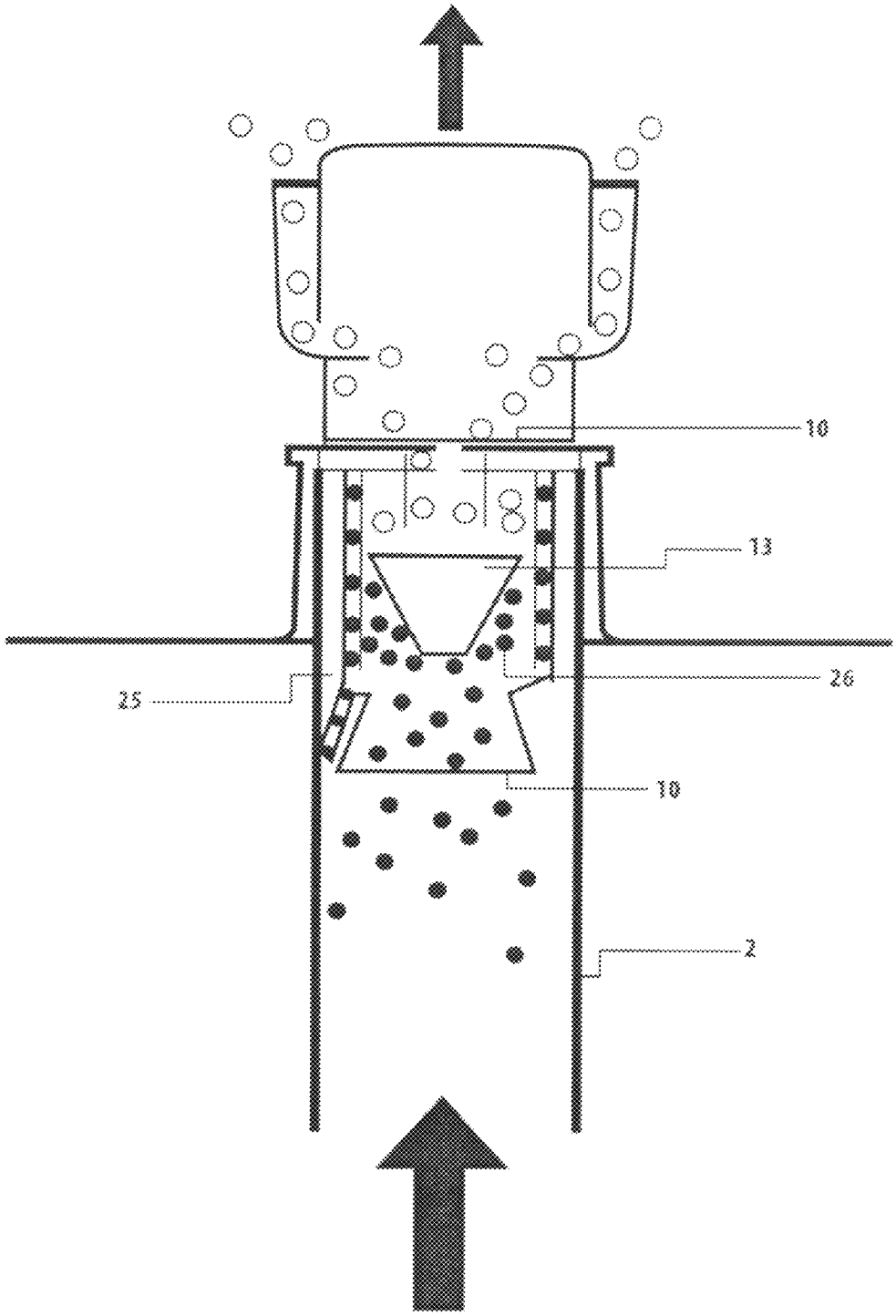
FIG. 11 is a side view of the present invention as installed above the roof top surface illustrating the process of removing grease and other contaminants from the hot exiting air.

FIG. 11 depicts the flow of contaminated air around the conically shaped occlusion [13]. Illustrating how grease or other contaminants from the air is forced, through centrifugal force, to become deposited along the inside surfaces of the exterior duct work [4]. Air, free of grease or other contaminants exits the separator device [12] through the air outlet [11] past the exhaust fan [7] and into the atmosphere. FIG. 14 also depicts how angled baffle plates [15] can be added to the conically shaped occlusion [13] to further increase the velocity of the air as the air flows past such occlusion. While at least one angled baffle plate [15] is necessary to increase air flow velocity, a minimum of three has been found to be most effective. Furthermore, the angled baffle plates [15] are sized in a way to allow them to fit between the surface of the conically shaped occlusion [13] and the inside surface of the exterior duct work [4] or the inside surface of the inner shell [26]. Additionally, as shown in FIG. 14, while the angled baffle plates [15] could be perpendicular to the air flow, it has been found that angling such plates in such a way as to force air in a circulation pattern the same as direction of the rotation of the exhaust fan [7] is most desired. Powering the exhaust fan [7] in stead of simply relying upon Bernoulli's principal to draw air through the vent system would increase the velocity of air flowing past the occlusion [13] and improve grease/contaminant removal.

Figure 7:
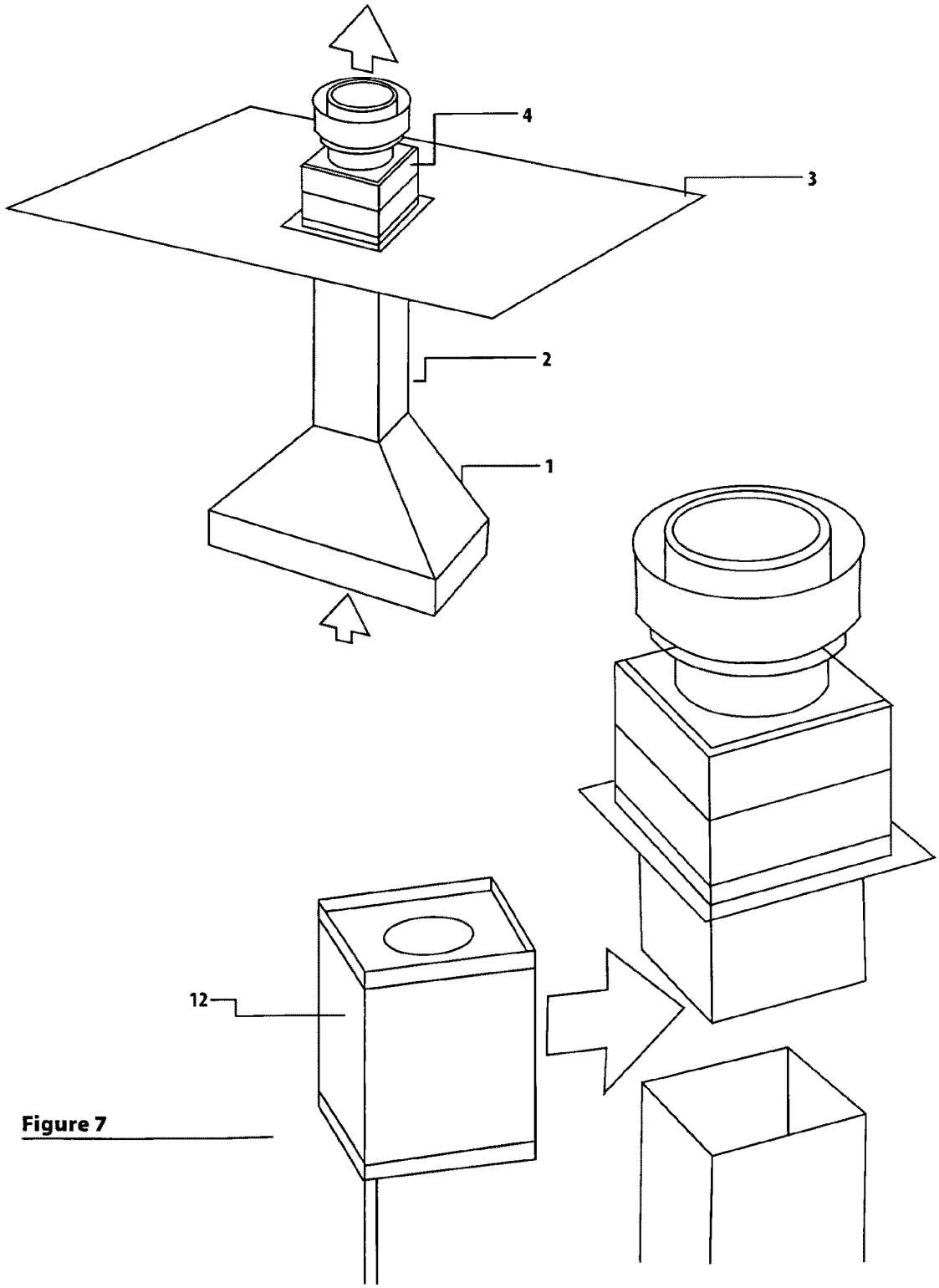
FIG. 7 illustrates another embodiment of the present invention wherein the invention is installed the roof top surface into existing duct work.
Figure 10:
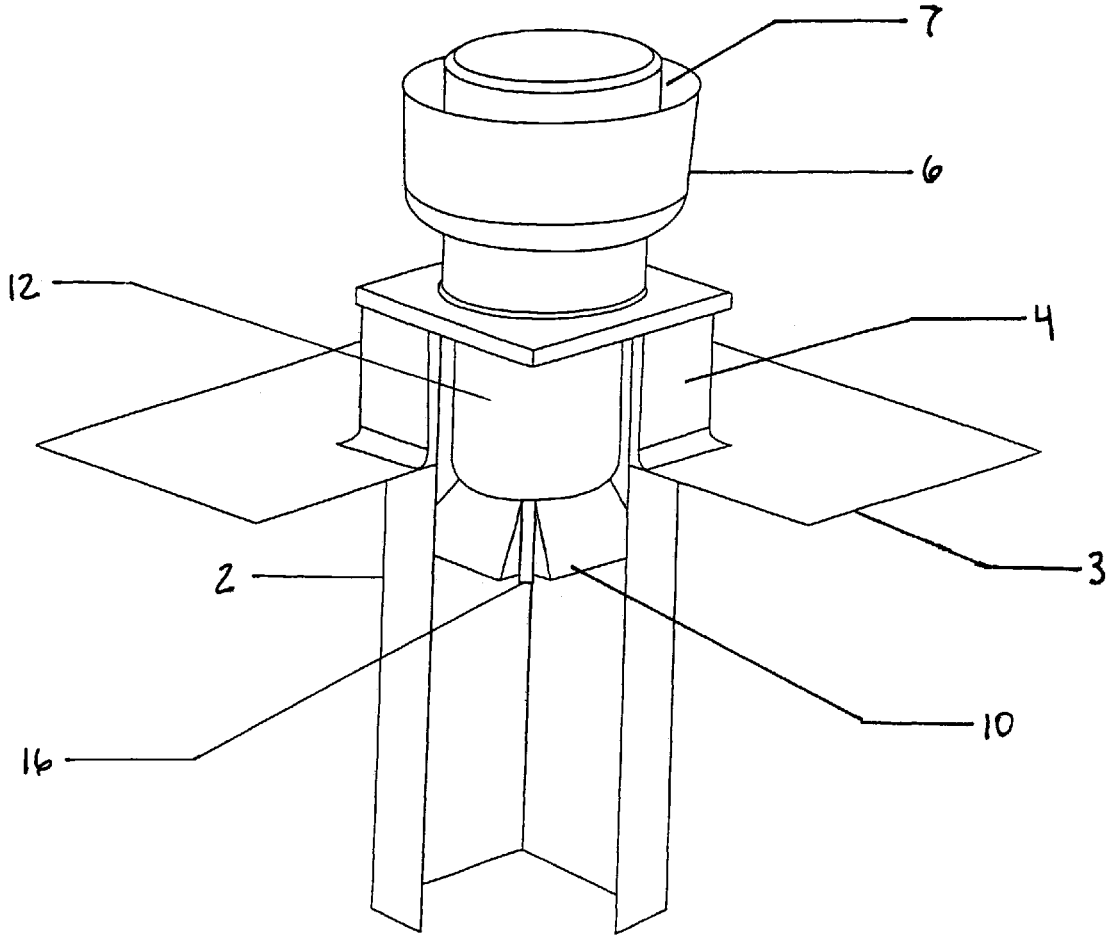
FIG. 10 is a side view of the present invention installed above the roof top surface.
Figure 12:
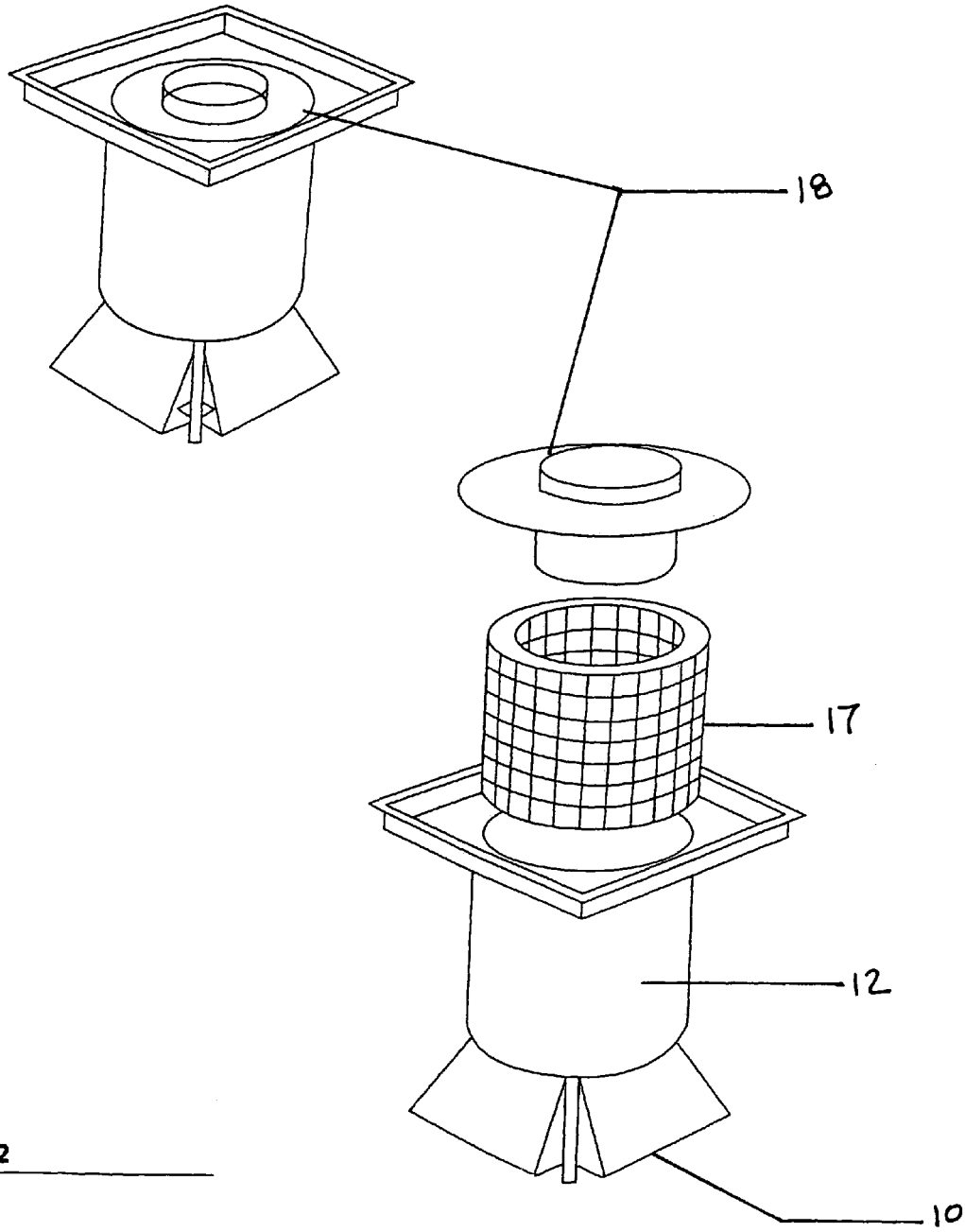
FIG. 12 illustrates another embodiment of the present invention wherein a replaceable containment media (filter) is utilized.
Figure 13:
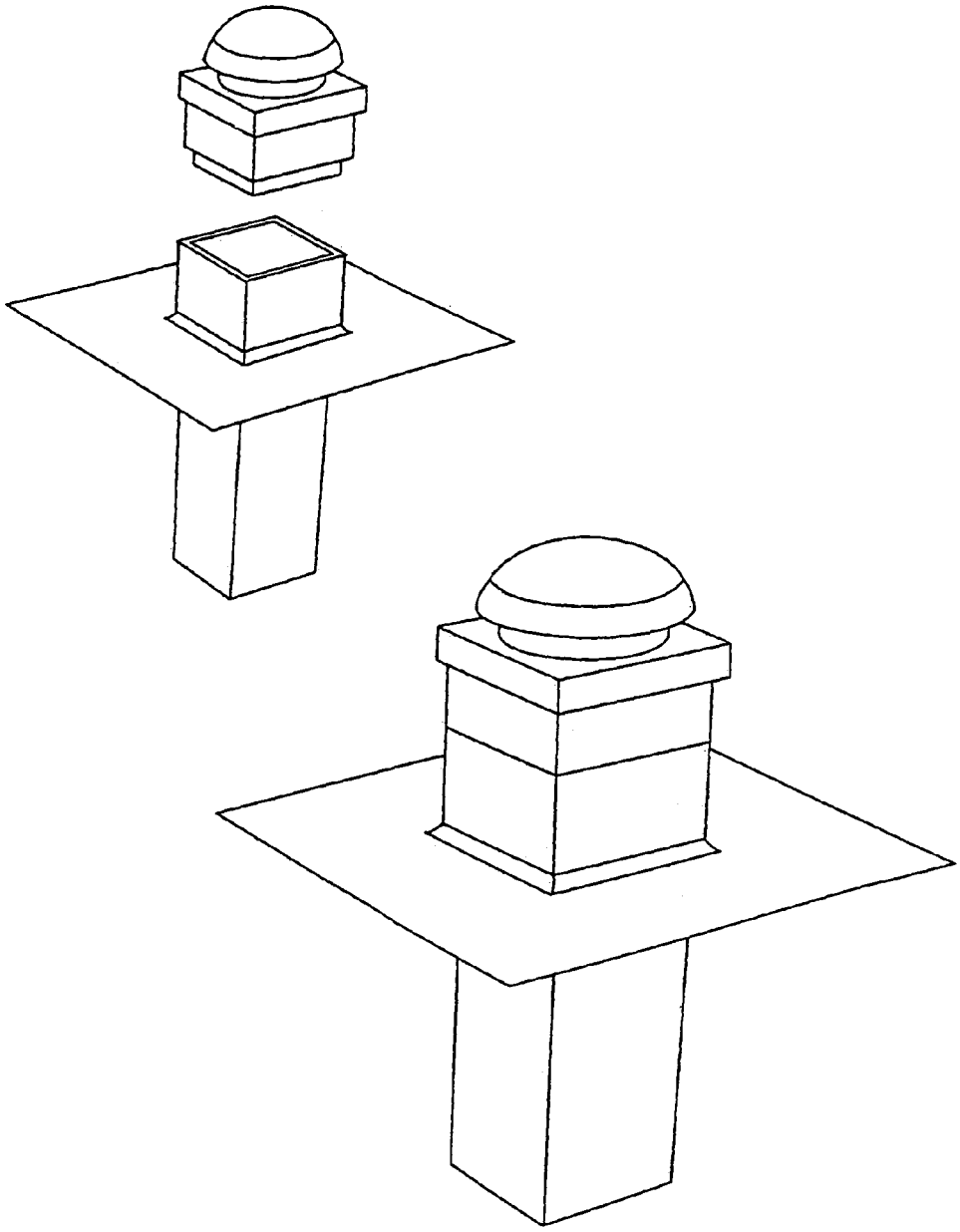
FIG. 13 depicts still another embodiment of the present invention illustrating the mist separator of the present invention in combination with a powered exhaust fan.

While the preferred embodiment of the present invention, as shown in FIG. 10, locates such invention directly below the exhaust fan [7] within the exterior duct work [4], FIG. 7 illustrates how such invention can be located below the roof surface [3] within the interior duct work [2]. FIG. 12 depicts how a removable/replaceable containment element (filter) [17], can be added to the separator device [12]. The containment element [17] has a diameter just small enough to allow placement between the inside surface of the exterior duct work [4] and the outside surface of the conically shaped occlusion [13] and is kept in place through a retainer ring [18] located on the mounting plate or bracket [9]. FIG. 13 illustrates that in another embodiment of the present invention, an exhaust fan [7] can be included in combination with the mist separator component [8].

While the preferred embodiments have been shown and described, it will be understood that there is no intent to limit the invention by such disclosure, but rather, is intended to cover all modifications and alternate constructions falling within the spirit and scope of the invention as defined in the appended claims.

The invention claimed is:

1. An exhaust air mist separator apparatus located above a roof top surface and directly below the exhaust fan in line with the grease exhaust system duct work comprising:

a mounting plate or bracket located at the top of such apparatus whose outside perimeter mates along and with the edges of the duct work; a funnel shaped air inlet at the bottom of said apparatus whose inlet perimeter mates against the inside surface of the duct work; an air outlet which mates to the inlet of the exhaust fan; a drain line through which grease is removed; and a separator device further comprising a conically shaped occlusion whose diameter at the air outlet is roughly the same diameter as such outlet and whose diameter at the air inlet is smaller, which is supportably attached to the inside surface of said device using any conventional means.

2. The apparatus of claim 1 wherein the conventional means used to supportably attach the conically shaped occlusion to the inside surface of the separator device is angle iron with one edge open to the direction of the air flow.

3. The apparatus of claim 1 further comprising a powered exhaust fan integral and attached to the top of the exhaust air mist separator.

4. The apparatus of claim 1 further comprising a grease containment element.

5. The apparatus of claim 1 wherein the conically shaped occlusion further comprises angled baffle plates.

6. An exhaust air mist separator apparatus located below a roof top surface in line with the grease exhaust system duct work comprising:

a mounting plate or bracket located at the top of such apparatus whose outside perimeter mates along and with the edges of the duct work; a funnel shaped air inlet at the bottom of said apparatus whose inlet perimeter mates against the inside surface of the duct work; an air outlet; a drain line through which grease is removed; and a separator device further comprising a conically shaped occlusion whose diameter at the air outlet is roughly the same diameter as such outlet and whose diameter at the air inlet is smaller, which is supportably attached to the inside surface of said device using any conventional means.

7. The apparatus of claim 6 wherein the conventional means used to supportably attach the conically shaped occlusion to the inside surface of the separator device is angle iron with one edge open to the direction of the air flow.

8. The apparatus of claim 6 further comprising a grease containment element.

9. The apparatus of claim 6 wherein the conically shaped occlusion further comprises angled baffle plates.

10. The apparatus of claim 6 further comprising a powered exhaust fan integral and attached to the top of the exhaust air mist separator.

11. An exhaust air mist separator apparatus located above a roof top surface and directly below the exhaust fan in line with the grease exhaust system duct work comprising:

a mounting plate or bracket located at the top of such apparatus whose outside perimeter mates along and with the edges of the duct work; a separator device having an inner and outer shell; holes on the surface of the inner shell; a funnel shaped air inlet at the bottom of said apparatus whose inlet perimeter mates against the inside surface of the inner shell; an air outlet which mates to the inlet of the exhaust fan; a drain line through which grease is removed and a separator device further comprising a conically shaped occlusion whose diameter at the air outlet is roughly the same diameter as such outlet and whose diameter at the air inlet is smaller, which is supportably attached to the inside surface of the inner shell using any conventional means.

12. The separator device of claim 11 wherein the conventional means used to supportably attach the conically shaped occlusion to the inside surface of the inner shell is angle iron with one edge open to the direction of the air flow.

13. The separator device of claim 11 wherein the conically shaped occlusion further comprises angled baffle plates.

14. The apparatus of claim 11 further comprising a powered exhaust fan integral and attached to the top of the exhaust air mist separator.

15. An exhaust air mist separator apparatus located in line with the grease exhaust system duct work comprising:

a mounting plate or bracket located at the top of such apparatus whose outside perimeter mates along and with the edges of the duct work; a separator device having an inner and outer shell; holes on the surface of the inner shell; a funnel shaped air inlet at the bottom of said apparatus whose inlet perimeter mates against the inside surface of the inner shell; an air outlet which mates to the inlet of the exhaust fan; a drain line through which grease is removed and a separator device further comprising a conically shaped occlusion whose diameter at the air outlet is roughly the same diameter as such outlet and whose diameter at the air inlet is smaller, which is supportably attached to the inside surface of the inner shell using angle iron with one edge open to the direction of the air flow.

16. The apparatus of claim 15 wherein the conically shaped occlusion further comprises angled baffle plates.

17. The apparatus of claim 15 further comprising a powered exhaust fan integral and attached to the top of the exhaust air mist separator.

* * * * *